US010561210B1

(12) United States Patent
Huang et al.

(10) Patent No.: US 10,561,210 B1
(45) Date of Patent: Feb. 18, 2020

(54) UMBRELLA, UMBRELLA PERIPHERAL AND METHODS

(71) Applicant: mCube, Inc., San Jose, CA (US)

(72) Inventors: Kevin Huang, San Jose, CA (US); Bruence Zhang, San Jose, CA (US)

(73) Assignee: mCube, Inc., San Jose, CA (US)

( * ) Notice: Subject to any disclaimer, the term of this patent is extended or adjusted under 35 U.S.C. 154(b) by 0 days.

(21) Appl. No.: 16/534,978

(22) Filed: Aug. 7, 2019

Related U.S. Application Data

(60) Provisional application No. 62/715,691, filed on Aug. 7, 2018.

(51) Int. Cl.

| | |
|---|---|
| ***A45B 3/04*** | (2006.01) |
| ***H05B 37/02*** | (2006.01) |
| ***H05B 33/08*** | (2006.01) |
| ***F21V 23/04*** | (2006.01) |
| ***F21L 4/00*** | (2006.01) |

(52) U.S. Cl.
CPC ..... *A45B 3/04* (2013.01); *F21L 4/00* (2013.01); *F21V 23/0471* (2013.01); *H05B 33/0842* (2013.01); *H05B 37/0272* (2013.01); *A45B 2200/1018* (2013.01)

(58) Field of Classification Search
CPC ..... H05B 33/08; H05B 33/0815; H05B 33/0842; H05B 33/0845; H05B 33/0854; H05B 37/02; H05B 37/0227; H05B 37/0272; A45B 3/04; A45B 2200/1018; F21L 4/00; F21V 23/0471
See application file for complete search history.

(56) References Cited

U.S. PATENT DOCUMENTS

2019/0069653 A1* 3/2019 Gharabegian ..... A45B 23/00

* cited by examiner

*Primary Examiner* — Jimmy T Vu
(74) *Attorney, Agent, or Firm* — Richard T. Ogawa; Ogawa P.C.

(57) ABSTRACT

A peripheral for an umbrella having a shaft, a handle and a canopy includes a power source, a sensor for determining when the canopy is open or closed, a light emitting diode (LED) on the top of the umbrella for outputting light, a MEMS accelerometer for determining physical orientations of the umbrella, and a processor for determining whether the umbrella is upright when the physical orientations of the umbrella are within a range of angles wherein the processor is for determining whether the umbrella is in a down configuration when the physical orientations of the umbrella are outside the range of angles, wherein the processor is for coupling the LED to the power source in response to the umbrella being upright and open, and wherein the processor is for decoupling the LED from the power source in response to the umbrella being in a down configuration and closed.

20 Claims, 4 Drawing Sheets

UMBRELLA, UMBRELLA PERIPHERAL AND METHODS

CROSS REFERENCE TO RELATED APPLICATIONS

The present invention is a non-provisional application of Prov. App. No. 62/715,691 filed Aug. 7, 2018 and incorporates it by reference for all purposes.

BACKGROUND OF THE INVENTION

The present invention relates to an illumination device. More specifically, the present invention relates a peripheral for an umbrella, an umbrella and methods.

Embodiments of the present invention relate to incorporating a light (e.g. LED) source on the top portion (e.g. ferrule) of an umbrella. Under control of a processor, depending upon the movement of the umbrella, the LED provides light that may enable third-parties to more readily see the umbrella and user and may enable the user of the umbrella to more readily see their surroundings.

In various embodiments, to control the lighting of the LED, various solutions were considered (not admitted as prior art) including: a user-operable physical on/off switch, a physical-based switch such as a ball-bearing switch or a mercury switch, a rain-sensing switch, ambient light sensor, or the like. Each of these embodiments have drawbacks. For example, with a user-operable switch, the user may forget to turn the LED on or the LED off, thus reducing visibility of the user when it is needed or reducing lifespan of a battery by the user forgetting to turn it off; with a physical-based switch, any significant deviation from a vertical orientation for the umbrella will cause the LED to turn off even though the light is still needed, for example, if the user is tilting the umbrella into the wind; with rain sensors, the LED may not turn on if the umbrella is used in in a snow storm, wind storm, sand storm, or in the dark, even though the light is needed; with a light sensor, the LED may turn-on while the umbrella is in the closet, when it is not needed; and the like.

In light of the above, what is desired are improved methods and apparatus to address the problem described above with reduced drawbacks.

BRIEF SUMMARY OF THE INVENTION

The present invention relates to an illumination device. More specifically, the present invention relates a peripheral for an umbrella, an umbrella and methods.

Embodiments of the present invention relate to incorporating a solid-state MEMS accelerometer in addition to a control unit (processor) to control the amount of power provided by a power source (e.g. battery, capacitor) to a light source (LED) mounted on the tip of an umbrella. In various embodiments, the LED light may be automatically controlled to turn on and stay on when the user is using the umbrella. In one example, the MEMS accelerometer is mounted within the umbrella and is used to determine the orientation of the umbrella with respect to gravity. For example, the processor may direct the LED to turn on and/or stay on when the MEMS accelerometer determines that the umbrella is pointed e.g. within +/−45 degrees from vertical, or the like. In another example, the processor may direct the LED to turn on and/or stay on when the MEMS accelerometer determines that the user is walking, e.g. measuring the activity or gait of the user. In other examples, a sensor may automatically determine when the umbrella canopy is open or closed, and turn on an LED when the canopy is open (sometimes in combination with other conditions). In further examples, the processor may direct the LED to remain on a period of time after an LED turn-on condition. In still other examples, combinations of the above may be used and combinations of the above in addition to other metrics (e.g. amount of ambient light, manual turn on of the LED by the user, and the like) may be used.

According to one aspect of the invention, a peripheral for an umbrella having a shaft with a bottom portion and a top portion, a handle coupled to the bottom portion and a canopy portion coupled to the top portion is disclosed. One device includes a power source configured to provide electrical power, and a sensor coupled to the power source, wherein the sensor is configured to determine when the canopy portion is in an open configuration or a closed configuration. An apparatus includes an illumination portion coupled to the top portion of the shaft and coupled to the power source, wherein the illumination portion comprises a light emitting diode (LED) configured to output light in response to the electrical power, and a MEMS accelerometer coupled to the power source, wherein the MEMS accelerometer is configured to determine physical orientations of the umbrella. A system includes a processor coupled to the power source, the LED and to the MEMS accelerometer, wherein the processor is configured to determine an upright configuration when the physical orientations of the umbrella are within a range of angles with respect to vertical, wherein the processor is configured to determine a non-upright configuration when the physical orientations of the umbrella are outside the range of angles with respect to vertical, wherein the processor is configured to couple the LED to the power source in response to the upright configuration and the open configuration, and wherein the processor is configured to decouple the LED from the power source in response to the non-upright configuration and the closed configuration.

According to another aspect of the invention, a method for a peripheral coupled to an umbrella is disclosed. A process may include determining with a sensor coupled to the umbrella, when the umbrella is in an open configuration, determining with a MEMS device coupled to the umbrella, an upright configuration when the umbrella is oriented within a range of angles with respect to vertical, and initiating with a processor coupled to the umbrella, illumination of a LED light source disposed upon a top portion of the umbrella, in response to the open configuration and the upright configuration. A methodology may include determining with the MEMS device, physical motion of the peripheral while the LED light source is illuminated, determining with the MEMS device, a non-upright configuration when the peripheral is oriented at an angle larger than the range of angles with respect to vertical while LED light source is illuminated, determining with the sensor, when the umbrella is in a closed configuration, while LED light source is illuminated, and terminating with the processor, the illumination of the LED light source, in response to the umbrella being in the closed configuration and the non-upright configuration.

According to yet another aspect of the invention, an umbrella is disclosed. A device includes a shaft comprising a bottom portion and a top portion, a handle coupled to the bottom portion the shaft, and a canopy portion coupled to the top portion of the shaft. An apparatus includes a power source configured to provide electrical power, a sensor coupled to the power source, wherein the sensor is configured to determine when the canopy portion is in an open configuration or a closed configuration, and an illumination portion coupled to the top portion of the shaft and coupled to the power source, wherein the illumination portion comprises a light emitting diode (LED) configured to output light. A peripheral may include a MEMS accelerometer coupled to the power source, wherein the MEMS accelerometer is configured to determine physical orientations of the umbrella, and a processor coupled to the power source, the LED and to the MEMS accelerometer, wherein the processor is configured to determine an upright configuration when the physical orientations of the umbrella with are within a range of angles with respect to vertical, wherein the processor is configured to determine a non-upright configuration when the physical orientations of the umbrella are outside the range of angles with respect to vertical, wherein the processor is configured to determine an idle condition when the physical orientations of the umbrella do not exceed a threshold physical motion for a predetermined period of time (e.g. 5-10 seconds), wherein the processor is configured to couple the LED to the power source in response to the upright configuration and the open configuration, and wherein the processor is configured to decouple the LED from the power source in response to the non-upright configuration and the closed configuration or in response to the idle condition.

BRIEF DESCRIPTION OF THE DRAWINGS

In order to more fully understand the present invention, reference is made to the accompanying drawings. Understanding that these drawings are not to be considered limitations in the scope of the invention, the presently described embodiments and the presently understood best mode of the invention are described with additional detail through use of the accompanying drawings in which.

DETAILED DESCRIPTION OF THE INVENTION

Figure 1A:
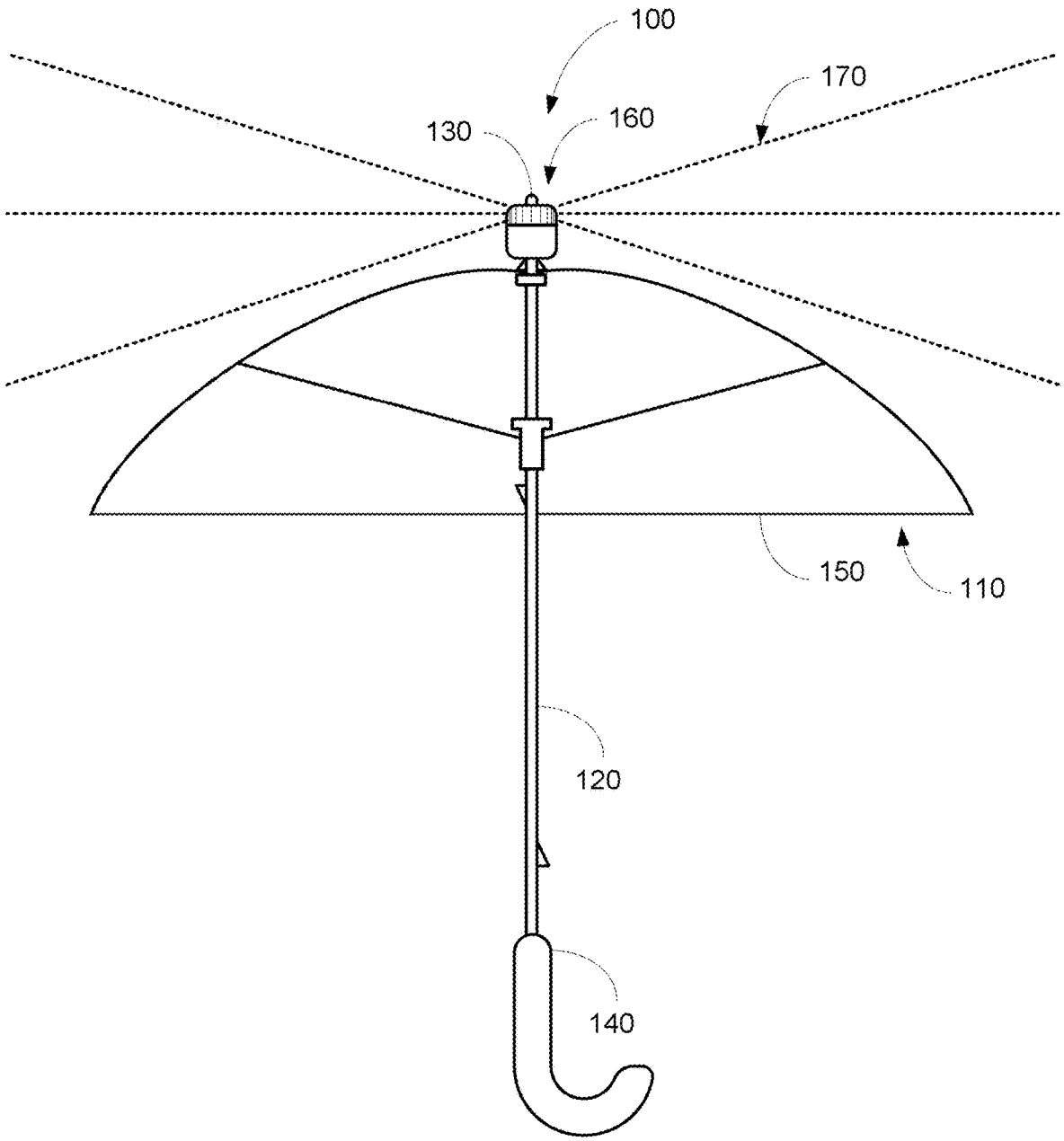
FIGS. 1A-C illustrate embodiments of the present invention.
Figure 1B:
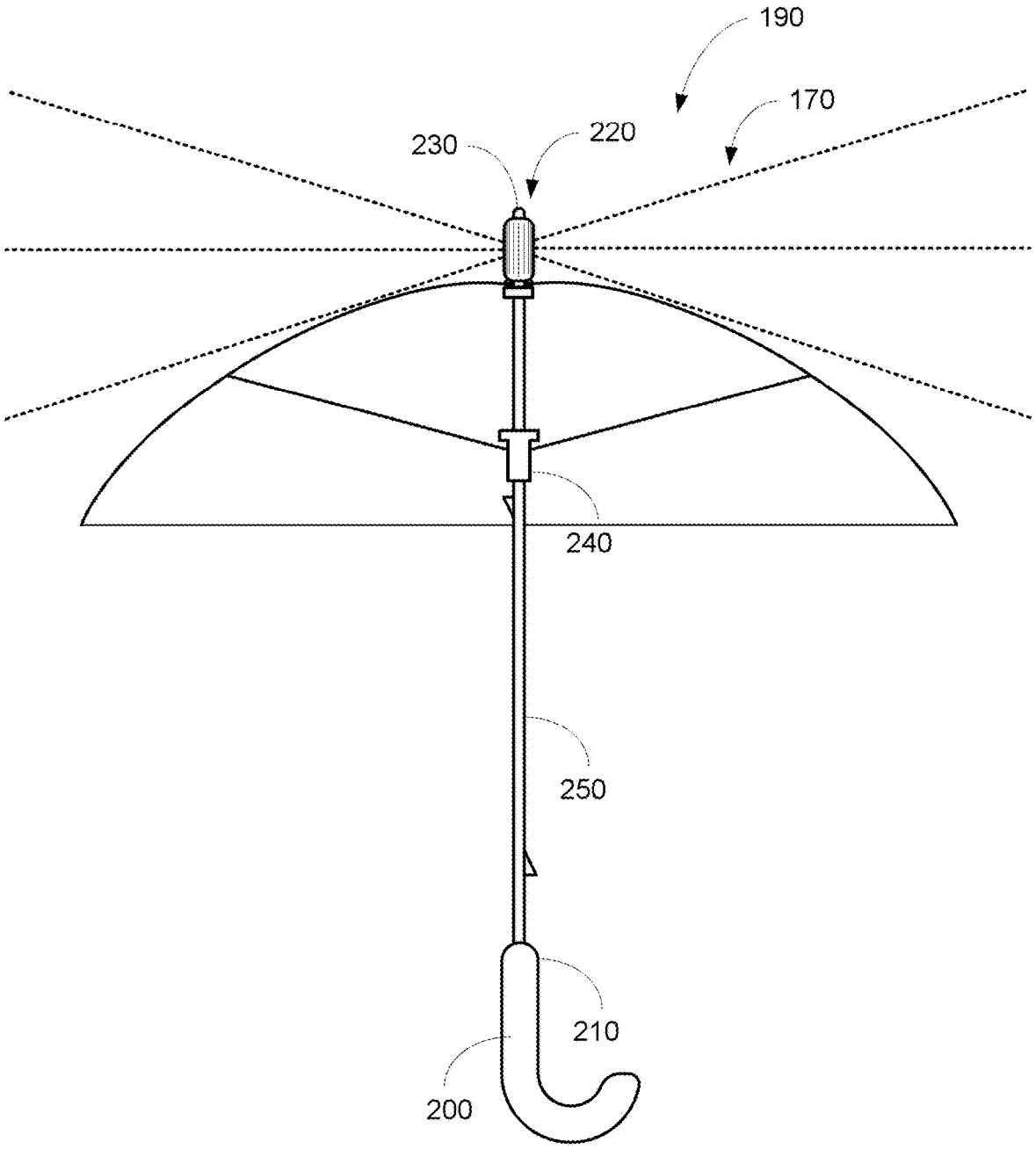
Figure 1C:
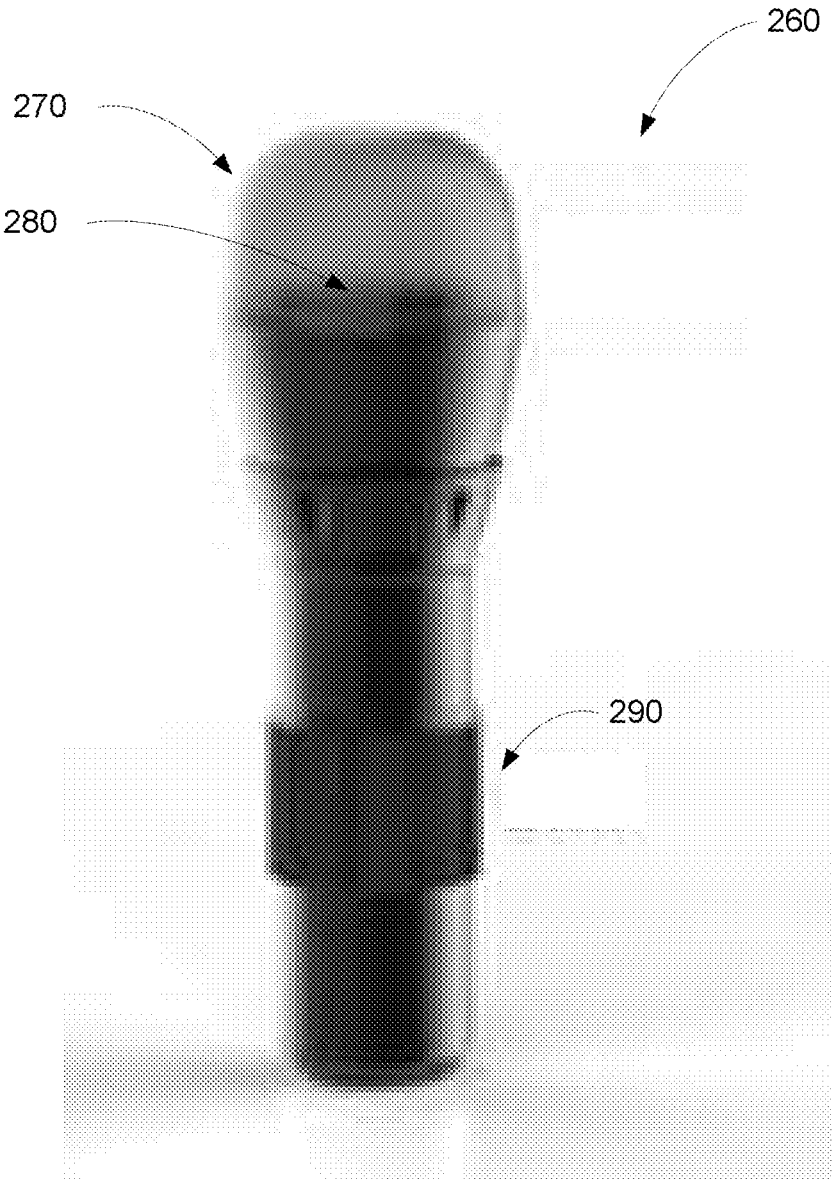

FIGS. 1A-C illustrates some embodiments of the present invention. More specifically, FIG. 1A illustrates a peripheral 100 for an umbrella 110. Umbrella 110 may include a shaft 120 having a top portion 130, a handle portion 140, and a canopy portion 150. Canopy portion 150 may have an open configuration during normal usage, and other non-open configurations of canopy portion 150 may be considered a closed or collapsed configuration (e.g. an open or a storage configuration). In some embodiments illustrated in FIG. 1A, peripheral 100 may be coupled, e.g. aftermarket, to umbrella 110, by a user. For example, peripheral 100 (including a battery, light source, etc.) may be physically coupled and secured by a user to top portion 130 of umbrella 100.

In some embodiments, one or more LEDs 160 are disposed within peripheral 100. As illustrated in FIG. 1A, LEDs 160 may output light 170. Output light 170 may be a constant brightness output or a non-constant brightness output (e.g. heartbeat, flashing). In some embodiments, output light 70 may have a single apparent color (e.g. white, yellow, etc.), or may have one or more apparent colors (e.g. cycling between green→red→yellow→green). In various embodiments, LEDs 160 may provide the apparent colors based upon LEDs having three different primary colors (e.g. red, blue, green), or the like. Output light 170 may provide umbrella 100 user with light for multiple purposes, such as: so the user can see their way at night; so that third-parties (e.g. drivers) can see the user at night; to indicate a status (e.g. law enforcement, status of an umbrella for hire (e.g. green versus red), belonging to a particular group (e.g. tour group) or status group, associated with a particular destination, marital status, relationship status (e.g. not seeing anyone), etc.; to provide a trademark color (e.g. pink for a Victoria's Secret umbrella); and the like.

In some embodiments illustrated in FIG. 1B, an umbrella 190 may have components similar to that described above integrated therein (e.g. within the hollow shaft, handle, etc.). For example, a battery 200 (e.g. rechargeable) may be integrated into handle portion 210, a light source (e.g. one or more LEDs) 220 may be integrated with top portion 230 to provide light 260. Additionally, one or more sensors 240 may be disposed within shaft 250, and the like. In some embodiments, umbrella 190 may have the same or different light producing functionality and characteristics as described above in the embodiments of FIG. 1A.

FIG. 1C illustrates a close-up of some embodiments of the present invention. More specifically, FIG. 1C illustrates a close-up of a top portion 260 of an umbrella. The embodiment illustrated may be an aftermarket product for an umbrella, as illustrated in FIG. 1A, or an integral portion of an umbrella, as illustrated in FIG. 1B. In this example, the tip 270 comprises a translucent material, under which one or more LEDs 280 are disposed. Tip 270 is thus the upper most portion of the umbrella, and provides light from LEDs 280 in an outwards manner.

In some embodiments, where top portion 260 may be an after-market product, a clamping mechanism 290 may be used to secure top portion 260 to the tip of an existing umbrella. In some embodiments, clamping mechanism 290 may be secure to a (metal or plastic) tip, ferrule (e.g. 130) of an umbrella via internal screw-like threads, an internal friction fit mechanism, a magnetic mechanism, or the like. In other embodiments, other types of lock mechanisms are contemplated, such as a set screw, adhesive, and the like.

In examples where an existing umbrella does not have a tip (e.g. 130), but a button-type top that is screwed into threads of the umbrella, typically found on folding umbrellas, the button top may be screwed-off. In some embodiments, top portion 260 may include a screw-like protrusion with threads that extends downwards. The screw of top portion 260 is then screwed into the threads of the umbrella to thereby secure them together. In some embodiments, a lock-type compound may be used to inhibit top portion 260 from inadvertently being unscrewed from the folding umbrella. In other embodiments, other types of securing techniques may be used, such as a friction fit, magnetic coupling, and the like.

Figure 2:
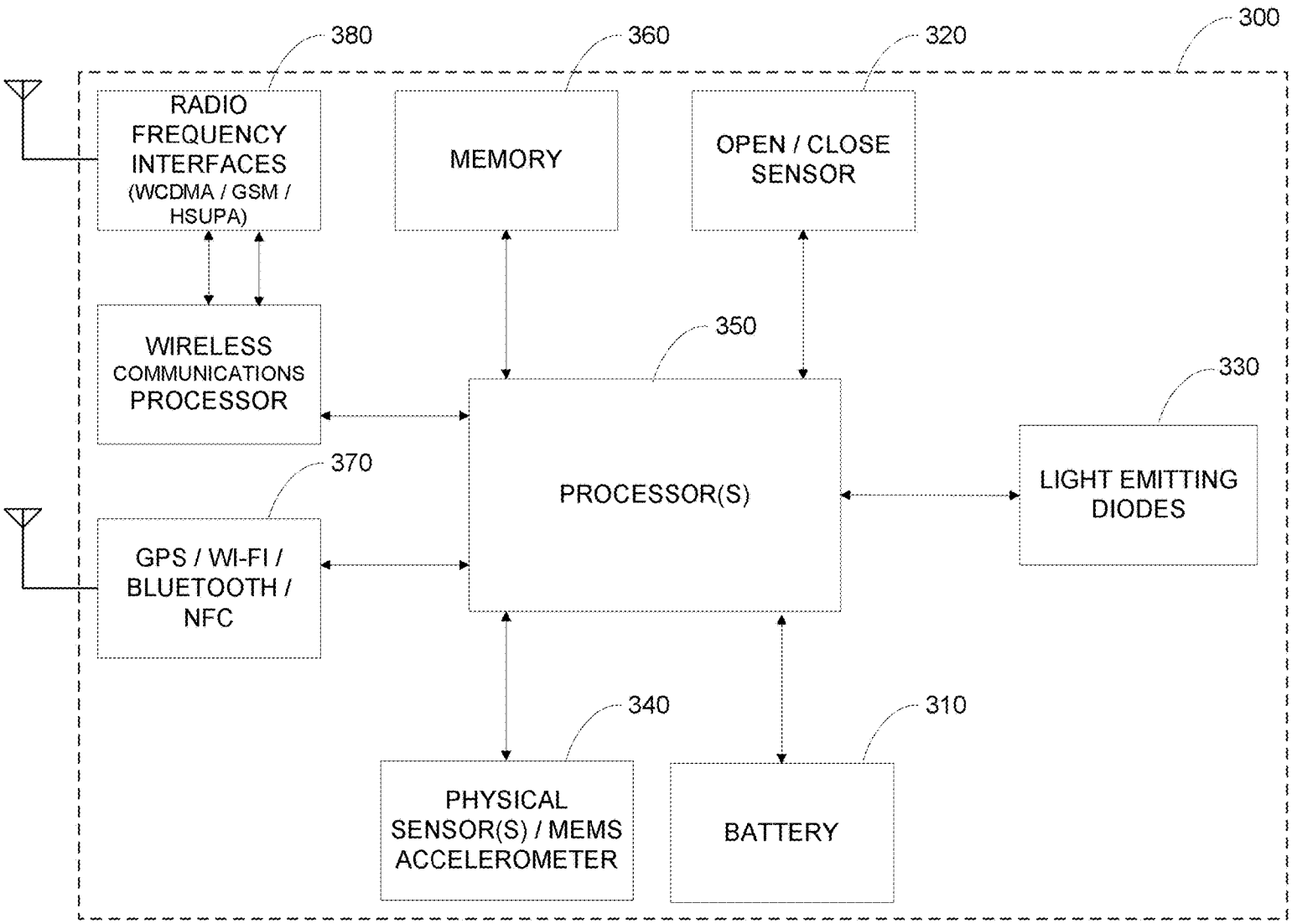
FIG. 2 illustrates another embodiment of the present invention.

FIG. 2 illustrates some embodiments of the present invention. More specifically, FIG. 2 illustrates a block diagram 300 of a device included in a peripheral for an umbrella or an umbrella having the functionality described above. In various embodiments, the device may include a power source 310, an open close sensor 320, one or more light emitting diodes (LEDs) 330, a MEMS accelerometer 340, a processor 350 and a memory 360.

In some embodiments, power source may be a user-replaceable battery (e.g. AA), or may be non-removable rechargeable battery. In some embodiments, the battery may be charged though a charging port (e.g. USB 3.0, micro USB, or the like), may be charged through a crank, solar power, or the like.

In some embodiments, open close sensor 320 is used to determine if the umbrella (e.g. canopy) is in an open position (or not). The sensor may be a physical switch, an optical sensor, positional sensor, or the like. As described further below, in some embodiments, the MEMS device 340 discussed herein may determine if the umbrella is open or not based upon movement characteristics of the umbrella opening or closing.

In various embodiments, a MEMS device 340 is provided. The MEMS device 340 may be embodied as a MEMS accelerometer (e.g. MC36xx, MC34xx accelerometer) offered by the assignee of the present invention, mCube. The MEMS device 340 may include three-axis positional data of the umbrella, with respect to gravity. For example, the MEMS device 340 may the angle of the umbrella, for example with respect to a vertical axis, the angle of the umbrella with respect to gravity, or the like. In various embodiments, the processor 350 receives data from the MEMS device 340 and determines whether the umbrella is considered upright (e.g. greater than 45 degrees from horizontal, etc.) The MEMS data and/or the processer determinations may be time stamped and stored in the memory 360.

In various embodiments, the MEMS device 340 also provides positional data of the umbrella while the user walks, the user waits, and the like. In some embodiments, the processor also receives the data from the MEMS device 340 and determines the movement characteristics of the user while the umbrella is in use, e.g. the user's gait, step rate, distance, vertical elevation gain, and the like. In some embodiments, the MEMS data may be combined with a magnetometer or the like to determine which direction the umbrella is pointed (e.g. usually pointed into the rain or wind). The MEMS data and/or the processer determinations as to the user's movement characteristics, the pointing direction, etc. may be time stamped and stored in the memory 360.

In various embodiments, any conventional low-power processor (e.g. Synopsys DesignWare ARC EM4 Processor) and memory (flash memory) may be used. In other embodiments, other types of processor appropriate for internet of things (IOT) applications are also contemplated.

In some embodiments, wireless interfaces 370 and 380 (transmit and/or receive functionality) may be provided such as a wide area wireless interface, a localized wireless interface (e.g. Bluetooth Low Energy (BLE), NFC, ZigBee, etc.), or the like. In some embodiments, GPS functionality may also be provided via a conventional GPS chip.

In some embodiments, the wireless interfaces 370 and 380 may be used to send or receive instructions from a remote device, e.g. a user's smart device. For example, configurations for operation of the umbrella (e.g. color, flashing) may be specified by a user via an application running upon the user's smart phone, and the configuration may be uploaded to the umbrella via NFC. As another example, usage data (e.g. when opened, path taken, when closed), user movement data (e.g. user step rate, etc.), etc. may be uploaded from the memory to the user's smart device. One or more applications running upon the user's smart device may perform further analysis to provide useful information to the user, such as number of steps, calories burned, route visualization, and the like. In still other embodiments, the usage data from multiple umbrellas may also be uploaded to a centralized server. The centralized server may for example, determine in real time where it is raining, and where it is not; determine in real time the wind conditions and directions; determine real-time geographic weather conditions (e.g. rain, wind, etc.) for microclimates; and the like. Such aggregate data may be pushed back to users and provide more accurate weather forecasts, or the like.

Further embodiments can be envisioned to one of ordinary skill in the art after reading this disclosure. For example, in some cases, the user's smart device, etc. may be used to set-up or configure embodiments of the present invention. For example, using the user's smart device, a user may turn on or off the LED light, may change the apparent color of the LED light, may change the blinking pattern of the LED light, may change the time out duration, and the like. In some embodiments, the angle offset from vertical is used to determine the characteristics of the LED light output. For example, if the umbrella is pointing straight upwards, the LED light may be white or have constant illumination, when the umbrella is angled 90 degrees from vertical, the LED light may be dimmer or may blink slowly, when the umbrella is angled 120 degrees from vertical, the LED light may be turned off or may blink even slower, etc. The offset from vertical may be determined by use of the aforementioned MEMS sensor. In further embodiments, a dedicated sensor to determine if the canopy of the umbrella is not used, instead the MEMS sensor may be used. In such cases, a MEMS sensor can determine ahead of time (e.g. manufacturing time, first uses by user, etc.) what the characteristic accelerations for the canopy sliding open and sliding closed. Later, as the user open or closes an umbrella, the series of accelerations received by the MEMS accelerator may be compared to these predetermined acceleration characteristics to determine if the accelerations sensed is an opening or closing event. As merely an example of this, a slide motion and a click may be associated with a canopy opening event, and a click and a slide motion may be associated with a canopy closing event. Based upon the type of event (and other such events), the LED light may be turned on/off/modulated, or the like, as discussed above. In some embodiments, a smart device may receive usage data from embodiments of the present invention, such as when the LED is used, where the LED is used, the duration of LED usage, the duration of an open umbrella configuration, a power level, and the like.

In other embodiments, combinations or sub-combinations of the above disclosed invention can be advantageously made. The block diagrams of the architecture and flow charts are grouped for ease of understanding. However, it should be understood that combinations of blocks, additions of new blocks, re-arrangement of blocks, and the like are contemplated in alternative embodiments of the present invention.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A peripheral for an umbrella having a shaft with a bottom portion and a top portion, a handle coupled to the bottom portion, a canopy portion coupled to the top portion comprises:

a power source configured to provide electrical power;

a sensor coupled to the power source, wherein the sensor is configured to determine when the canopy portion is in an open configuration or a closed configuration;

an illumination portion coupled to the top portion of the shaft and coupled to the power source, wherein the illumination portion comprises a light emitting diode (LED) configured to output light in response to the electrical power;

a MEMS accelerometer coupled to the power source, wherein the MEMS accelerometer is configured to determine physical orientations of the umbrella;

a processor coupled to the power source, the LED and to the MEMS accelerometer, wherein the processor is configured to determine an upright configuration when the physical orientations of the umbrella are within a range of angles with respect to vertical, wherein the processor is configured to determine an off configuration when the physical orientations of the umbrella are outside the range of angles with respect to vertical, wherein the processor is configured to couple the LED to the power source in response to the upright configuration and the open configuration, and wherein the processor is configured to decouple the LED from the power source in response to the off configuration and the closed configuration.

2. The umbrella of claim 1 wherein the processor is configured to determine a period of time after the umbrella is in the closed configuration and the off configuration;

wherein the processor is configured to determine an idle condition when the period of time exceeds a predetermined amount of time; and wherein the processor is configured to decouple the LED from the power source also in response to the off configuration, the closed configuration, and the idle condition.

3. The umbrella of claim 1 wherein the processor is configured to determine an idle condition when the physical orientations of the umbrella does not exceed a threshold physical motion for a predetermined period of time; and wherein the processor is configured to decouple the LED from the power source in response to the idle condition.

4. The umbrella of claim 1 wherein the range of angles is greater than 0 degrees to and less than 90 degrees.

5. The umbrella of claim 1 wherein the sensor comprises the MEMS accelerometer.

6. The umbrella of claim 1 wherein an appearance of the light that is output from the LED is selected from a group consisting of: a steady illumination, a blinking illumination, a constant appearance color, a changing appearance color.

7. The umbrella of claim 1 further comprising:

a wireless transmitter coupled to the power source and to the processor, wherein the wireless transmitter provides a first indication to a smart device of when the LED outputs light; and wherein the wireless transmitter provides a second indication to the smart device of when the LED terminates output of the light.

8. The umbrella of claim 1 wherein the processor is configured to determine movement characteristics associated with the user in response to the physical orientations of the umbrella; and wherein the movement characteristics associated with the user are selected from a group consisting of: cadence, gait, and speed.

9. The umbrella of claim 1 further comprising:

a wireless receiver coupled to the power source, wherein the wireless receiver is configured to receive from a user device, a termination signal; and wherein the processor is configured to decouple the LED from the power source in response to the termination signal.

10. A method for a peripheral coupled to an umbrella comprises:

determining when the umbrella is in an open configuration;

determining with a MEMS device coupled to the umbrella, an upright configuration when the umbrella is oriented within a range of angles with respect to vertical;

initiating with a processor coupled to the umbrella, illumination of a LED light source disposed upon a top portion of the umbrella, in response to the open configuration and the upright configuration; thereafter:

determining with the MEMS device, physical motion of the peripheral while the LED light source is illuminated;

determining with the MEMS device, an off configuration when the peripheral is oriented at an angle larger than the range of angles with respect to vertical while LED light source is illuminated;

determining with the sensor, when the umbrella is in a closed configuration, while LED light source is illuminated; and terminating with the processor, the illumination of the LED light source, in response to the umbrella being in the closed configuration and the off configuration.

11. The method of claim 10 further comprising:

determining with the processor, an idle condition when a period of time after the umbrella is in the closed configuration and in the off configuration exceeds a predetermined amount of time; and wherein the terminating with the processor, the illumination of the LED light source is in response to the closed configuration, the off configuration, and the idle condition.

12. The method of claim 10 further comprising:

determining with the processor, an idle condition when the physical motion of the umbrella does not exceed a threshold physical motion for a predetermined period of time; and wherein the method further comprises terminating with the processor, the illumination of the LED light source in response to the idle condition.

13. The method of claim 10 wherein the range of angles is greater than 0 degrees to 45 degrees.

14. The method of claim 10 wherein the illumination of the LED light source is selected from a group consisting of: a steady illumination, a blinking illumination, a constant appearance color, a changing appearance color.

15. The method of claim 10 further comprising:

indicating with the processor, to a smart device when illumination of the LED light source is initiated; and indicating with the processor, to the smart device when illumination of the LED light source is terminated.

16. The method of claim 15 further comprising:

providing with the processor to a user device, when the illumination of the LED light source is initiated;

combining, in the user device, when the illumination of the LED light source is initiated with a first time stamp and a first geographical position of the umbrella, to form a first data packet; and uploading, with the user device, the first data packet to a smart device.

17. The method of claim 16 further comprising:

providing with the processor to the user device, when the illumination of the LED light source is terminated;

combining, in the user device, when the illumination of the LED light source is terminated with a second time stamp and a second geographical position of the umbrella, to form a second data packet; and uploading, with the smart device, the second data packet to the smart device.

18. The method of claim 10 further comprising:

providing with the processor to a user device, the physical motion of the umbrella while the LED light source is illuminated; and determining, in the user device, movement characteristics associated with the user, in response to the physical motion;

wherein the movement characteristics associated with the user laare selected from a group consisting of: cadence, gait, and speed.

19. The method of claim 10 further comprising:

receiving a termination signal in the processor, from a user device via a wireless interface; and terminating with the processor, the illumination of the LED light source, in response to the termination signal.

20. An umbrella comprising:

a shaft comprising a bottom portion and a top portion;

a handle coupled to the bottom portion the shaft;

a canopy portion coupled to the top portion of the shaft;

a power source configured to provide electrical power;

a sensor coupled to the power source, wherein the sensor is configured to determine when the canopy portion is in an open configuration or a closed configuration;

an illumination portion coupled to the top portion of the shaft and coupled to the power source, wherein the illumination portion comprises a light emitting diode (LED) configured to output light;

a MEMS accelerometer coupled to the power source, wherein the MEMS accelerometer is configured to determine physical orientations of the umbrella;

a processor coupled to the power source, the LED and to the MEMS accelerometer, wherein the processor is configured to determine an upright configuration when the physical orientations of the umbrella with are within a range of angles with respect to vertical, wherein the processor is configured to determine an off configuration when the physical orientations of the umbrella are outside the range of angles with respect to vertical, wherein the processor is configured to determine an idle condition when the physical orientations of the umbrella do not exceed a threshold physical motion for a predetermined period of time, wherein the processor is configured to couple the LED to the power source in response to the upright configuration and the open configuration, and wherein the processor is configured to decouple the LED from the power source in response to the off configuration and the closed configuration or in response to the idle condition.

* * * * *